US009831568B2

(12) United States Patent
Giefers

(10) Patent No.: US 9,831,568 B2
(45) Date of Patent: Nov. 28, 2017

(54) ELECTRICAL CONNECTION TERMINAL

(71) Applicant: Phoenix Contact GmbH & Co. KG, Blomberg (DE)

(72) Inventor: Stefan Giefers, Detmold (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/122,641

(22) PCT Filed: Mar. 17, 2015

(86) PCT No.: PCT/EP2015/055524
§ 371 (c)(1),
(2) Date: Aug. 31, 2016

(87) PCT Pub. No.: WO2015/140148
PCT Pub. Date: Sep. 24, 2015

(65) Prior Publication Data

US 2017/0069978 A1 Mar. 9, 2017

(30) Foreign Application Priority Data

Mar. 17, 2014 (DE) ..... 10 2014 103 638

(51) Int. Cl.
*H01R 4/48* (2006.01)

(52) U.S. Cl.
CPC ..... *H01R 4/4809* (2013.01)

(58) Field of Classification Search
CPC .. H01R 4/4809; H01R 4/4836; H01R 4/4845; H01R 4/4827
USPC ..... 439/816
See application file for complete search history.

(56) References Cited

U.S. PATENT DOCUMENTS 7,896,686 B2 * 3/2011 Hoppe ..... H01R 4/4827 439/441
8,328,588 B2 * 12/2012 Ramm ..... H01R 4/4845 439/828
8,632,355 B2 * 1/2014 Hartmann ..... H01R 4/4845 439/411
9,502,790 B2 * 11/2016 Kollmann ..... H01R 4/4836
(Continued)

FOREIGN PATENT DOCUMENTS

DE 102004046471 B3 2/2006
DE 102007024661 A1 11/2007
(Continued)

*Primary Examiner* — Jean F Duverne
(74) *Attorney, Agent, or Firm* — Leydig, Voit & Mayer, Ltd.

(57) ABSTRACT

An electrical connection terminal includes a metal part having a contact leg and a fastening leg which is connected to the contact leg by a web, the fastening leg having a spring receiving portion which has an inner side, an outer side, and an opening arranged in the spring receiving portion, and the contact leg having a contact portion which has an inner side and an outer side. A clamping spring can be mounted on the metal part, the clamping spring having a spring leg which has an end portion, a ridge connected to the spring leg on a side of the spring leg which faces away from the end portion, and a holding leg connected to the ridge. The ridge has a first recess and the holding leg has a second recess. The holding leg includes two side clips arranged in parallel with one another.

8 Claims, 2 Drawing Sheets

(56) References Cited

U.S. PATENT DOCUMENTS

| | | | |
|---|---|---|---|
| 2006/0063420 | A1 | 3/2006 | Reibke et al. |
| 2010/0081346 | A1 | 4/2010 | Hoppe |

FOREIGN PATENT DOCUMENTS

| | | | |
|---|---|---|---|
| DE | 102006057712 | B3 | 4/2008 |
| DE | 102007024690 | A1 | 12/2008 |
| DE | 102008025433 | A1 | 9/2009 |
| DE | 102008039219 | A1 | 2/2010 |
| DE | 202009016064 | U1 | 4/2011 |

* cited by examiner

ELECTRICAL CONNECTION TERMINAL

CROSS-REFERENCE TO PRIOR APPLICATIONS

This application is a U.S. National Phase application under 35 U.S.C. §371 of International Application No. PCT/EP2015/055524, filed on Mar. 17, 2015, and claims benefit to German Patent Application No. DE 10 2014 103 638.7, filed on Mar. 17, 2014. The International Application was published in German on Sep. 24, 2015 as WO 2015/140148 A1 under PCT Article 21(2).

FIELD

The invention relates to an electrical connection terminal for receiving and electrically contacting an electrical conductor.

BACKGROUND

Electrical connection terminals for receiving and electrically contacting an electrical conductor are generally known from practice. Electrical connection terminals of this kind generally have a metal part, which comprises a holding portion and a contact portion, and a spring clamp which is fastened to the metal part and comprises an angled fastening portion. For fastening the spring clamp to the metal part, a stamped latching lug is often arranged on the holding portion and a receiving opening is often arranged in the fastening portion, in which opening the latching lug engages.

Stamped latching lugs generally only have a small height and therefore have the disadvantage that the fastening of the clamping spring on the metal part is sensitive to tolerances. In addition, additional bending processes are required in producing the spring clamp owing to the fastening portion being angular.

SUMMARY

An electrical connection terminal includes a metal part having a contact leg and a fastening leg which is connected to the contact leg by a web, the fastening leg having a spring receiving portion which has an inner side, an outer side, and an opening arranged in the spring receiving portion, and the contact leg having a contact portion which has an inner side and an outer side. A clamping spring can be mounted on the metal part, the clamping spring having a spring leg which has an end portion, a ridge connected to the spring leg on a side of the spring leg which faces away from the end portion, and a holding leg connected to the ridge. The ridge has a first recess and the holding leg has a second recess. The holding leg includes two side clips arranged in parallel with one another, a lower contact leg, and an upper transverse web, the upper transverse web separating the first recess in the ridge and the second recess in the holding leg from one another. A first tab is formed on the upper transverse web. The clamping spring can be mounted on the metal part such that the first tab engages in the opening in the spring receiving portion from the inner side and the end portion of the spring leg rests against the inner side of the contact portion so as to exert a spring force on the inner side of the contact portion.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
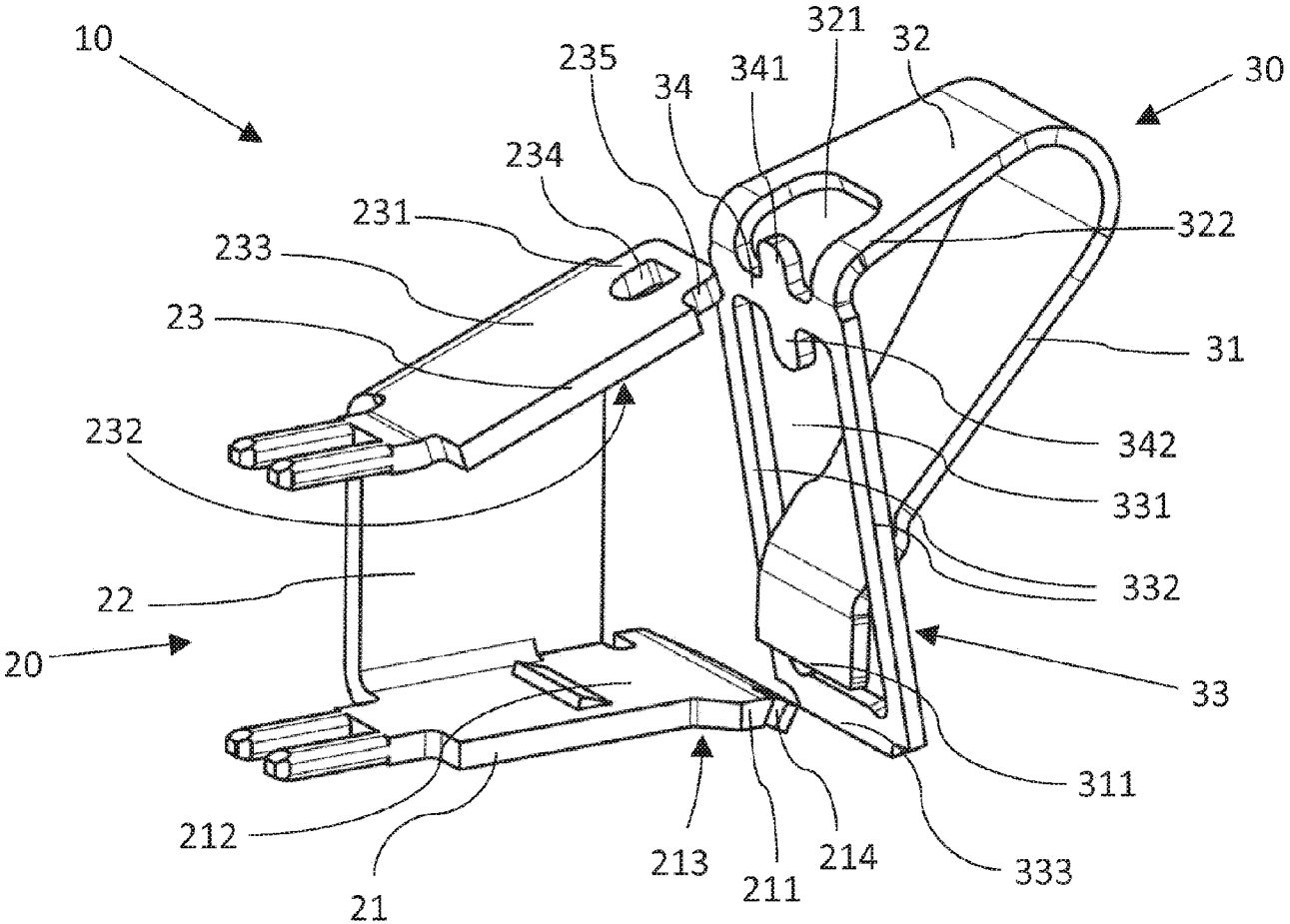
FIG. 1 is an exploded view of an electrical connection terminal according to a preferred embodiment of the invention and FIG. 2 is a three-dimensional view of the electrical connection terminal according to the preferred embodiment of the invention.

According to the invention, an electrical connection terminal is thus provided which comprises a metal part and a clamping spring that can be mounted on the metal part, the metal part having a contact leg and a fastening leg which is connected to the contact leg by a web, the fastening leg having a spring receiving portion which has an inner side, an outer side and an opening arranged in the spring receiving portion, and the contact leg comprising a contact portion which has an inner side and an outer side, the clamping spring having a spring leg which has an end portion, a ridge connected to the spring leg on the side which faces away from the end portion and a holding leg connected to the ridge, the ridge having a first recess and the holding leg having a second recess, the second recess being designed such that the holding leg comprises two side clips arranged in parallel with one another, a lower contact leg and an upper transverse web, and the upper transverse web separates the first recess in the ridge and the second recess in the holding leg from one another, characterized in that a first tab is formed on the upper transverse web and the clamping spring can be mounted on the metal part such that the first tab engages in the opening in the spring receiving portion from the inner side and the end portion of the spring leg rests against the inner side of the contact portion and exerts a spring force on the inner side of the contact portion.

Therefore, it is an aspect of the invention that the ridge has a first recess and the holding leg has a second recess, the first recess and the second recess are separated from one another by the upper transverse web and a first tab is formed on the upper transverse web, the first tab engaging in the opening arranged in the spring receiving portion of the fastening leg in order to fasten the clamping spring to the metal part from the inner side, and the end portion of the spring leg resting against the inner side of the contact portion.

A further preferred development of the invention provides that the upper transverse web rests against the inner side of the spring receiving portion. In this way, the spring force exerted by the spring leg is introduced into the spring receiving portion of the fastening leg by the upper transverse web as a force of reaction.

The length of the first tab can vary. Therefore, the first tab can also have a length that is greater than the material thickness of the fastening leg. However, a particularly preferred development of the invention provides that the length of the first tab corresponds to the material thickness of the fastening leg. In this way, a length of the first tab is specified which provides secure fastening of the clamping spring to the fastening leg.

In addition, a preferred development of the invention is that a region of the contact portion is angled downwards and the lower contact leg rests against the outer side of the angled contact portion. In this way, the clamping spring is fixed to the contact portion such that rotation of the clamping spring about the axis of the upper transverse web can be reduced.

According to another preferred development of the invention, it is provided that the edge region of the contact portion comprises two indentations, in each of which a side clip engages. In this way, fixing of the clamping spring to the metal part is provided in the region of the contact portion, which prevents rotation about the longitudinal axis of the first tab.

In addition, a preferred development of the invention provides that the first recess is designed such that the ridge has two ribs which are arranged in parallel with one another, the spring receiving portion of the fastening leg has two indentations in the edge region and one rib engages in each recess. In this way, fixing of the clamping spring to the metal part is provided in the region of the spring receiving portion, which prevents rotation about the longitudinal axis of the first tab.

For the electrical connection of a stripped conductor end to the electrical connection terminal, the stripped conductor end is clamped between the end portion of the spring leg and the inner side of the contact portion. For inserting the stripped conductor end in the electrical connection terminal, the spring leg of the clamping spring is pivoted. In order to prevent the clamping spring being overloaded when the spring leg is pivoted, a preferred development of the invention provides that the upper transverse web has a second tab facing the opposite direction to the first tab. The second tab acts as a stop for the spring leg and reduces the pivot angle of the spring leg.

Lastly, another preferred development of the invention is that the clamping spring and the metal part are punched bent parts. In this way, the clamping spring and metal part can be produced at low cost. Since the first tab and the second tab are formed on the upper transverse web, and the upper transverse web separates the first recess and the second recess from one another, the first tab can be formed in the punching process of the first recess and the second tab can be formed in the punching process of the second recess, independently of one another in terms of length and width.

FIG. 1 shows an electrical connection terminal 10, comprising a metal part 20 and a clamping spring 30 that can be mounted on the metal part 20.

The metal part 20 comprises a contact leg 21 and a fastening leg 23 connected to the contact leg 21 by a web 22. It can also be seen that the fastening leg 23 comprises a spring receiving portion 231 which has an inner side 232, an outer side 233 and an opening 234 arranged in the spring receiving portion 231, and the contact leg 21 comprises a contact portion 211 which has an inner side 212 and an outer side 213.

The clamping spring 30 comprises a spring leg 31 which has an end portion 311, a ridge 32 which is connected to the spring leg 31 on the side which faces away from the end portion 311, and a holding leg 33 which is connected to the ridge 32.

The ridge 32 comprises a first recess 321 and the holding leg 33 comprises a second recess 331, the second recess 331 being designed such that the holding leg 33 comprises two side clips 332 arranged in parallel with one another, a lower contact leg 333 and an upper transverse web 34. It can also be seen that the upper transverse web 34 separates the first recess 321 in the ridge 32 and the second recess 331 in the holding leg 33 from one another, and a first tab 341 is formed on the upper transverse web 34. The clamping spring 30 can be mounted on the metal part 20 such that the first tab 341 engages in the opening 234 in the spring receiving portion 231 from the inner side 232, and the end portion 311 of the spring leg 31 rests against the inner side 212 of the contact portion 21 and exerts a spring force on the inner side 212 of the contact portion 21.

Figure 2:
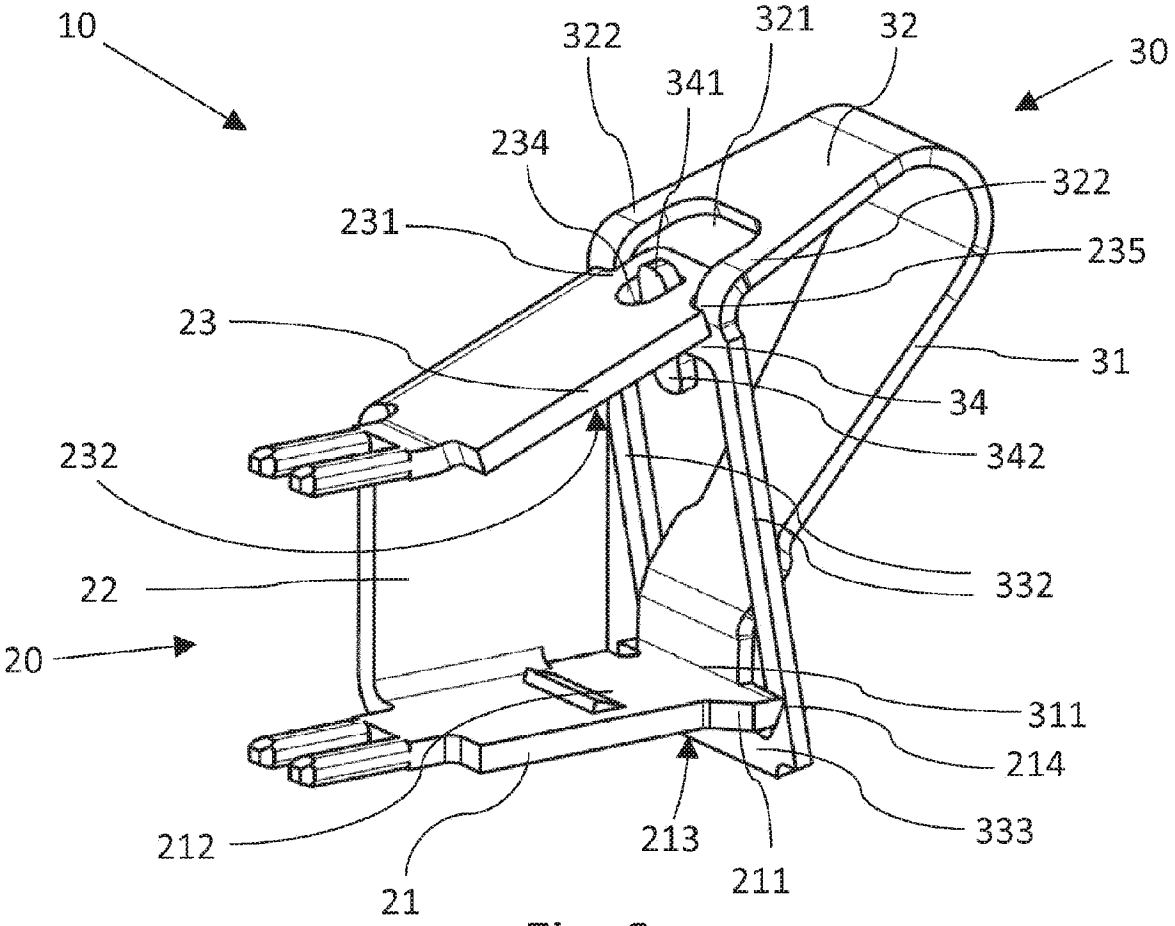

FIG. 2 shows the clamping spring 30 mounted on the metal part 20. It can be seen that in the mounted state the upper transverse web 34 rests against the inner side 232 of the spring receiving portion 231. In this way, the spring force exerted by the spring leg 31 is introduced into the spring receiving portion 231 of the fastening leg 23 by the upper transverse web 34 as a force of reaction.

It can also be seen that a region of the contact portion 211 is angled downwards and the lower contact leg 333 rests against the outer side 213 of the angled contact portion 211. In this way, the clamping spring 30 is fixed to the contact portion 211 such that rotation of the clamping spring 30 about the axis of the upper transverse web 34 can be reduced or even completely prevented.

In the edge region of the contact portion 211, two indentations 214 are arranged, in each of which a side clip 332 engages. In this way, fixing of the clamping spring 30 to the metal part 20 is achieved in the region of the contact portion 211, which prevents rotation about the longitudinal axis of the first tab 341.

Alternatively or in addition to fixing the clamping spring 30 in the region of the contact portion 211 in order to prevent the clamping spring 30 from rotating about the longitudinal axis of the first tab 341, suitable fixing can take place at the spring receiving portion 231. For this purpose, the first recess 321 is formed such that the ridge 32 has two ribs 322 which are arranged in parallel with one another. The spring receiving portion 231 of the fastening leg 23 has two indentations 235 arranged in the edge region and one rib 322 engages in each recess 235. In this way, fixing of the clamping spring 30 to the metal part 20 is provided in the region of the spring receiving portion 231, which prevents rotation about the longitudinal axis of the first tab 341.

A second tab 342 facing the opposite direction to the first tab 341 is formed on the upper transverse web 34. Said second tab 342 is used to prevent the clamping spring 30 being overloaded when the spring leg 31 is pivoted for contacting an electrical conductor end between the end portion 311 of the spring leg 31 and the inner side 212 of the contact portion 211.

Both the clamping spring 30 and the metal part 20 are punched bent parts. In this way, the clamping spring 30 and the metal part 20 can be produced at low cost. Since the first tab 341 and the second tab 342 are formed on the upper transverse web 34, and the upper transverse web 34 separates the first recess 321 and the second recess 331 from one another, the first tab 341 can be formed in the punching process of the first recess 321 and the second tab 342 can be formed in the punching process of the second recess 331, independently of one another in terms of length and width.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

10 electrical connection terminal
20 metal part
21 contact leg
211 contact portion
212 inner side
213 outer side
214 indentation
22 web
23 fastening leg
231 spring receiving portion
232 inner side
233 outer side
234 opening
235 indentations
30 clamping spring
31 spring leg
311 end portion
32 ridge
321 first recess
322 ribs
33 holding leg
331 second recess
332 side clip
333 contact leg
34 transverse web
341 first tab
342 second tab

The invention claimed is:

1. An electrical connection terminal, comprising:

a metal part having a contact leg and a fastening leg which is connected to the contact leg by a web, the fastening leg having a spring receiving portion which has an inner side, an outer side, and an opening arranged in the spring receiving portion, the contact leg including a contact portion which has an inner side and an outer side; and a clamping spring configured to be mounted on the metal part, the clamping spring having a spring leg which has an end portion, a ridge connected to the spring leg on a side of the spring leg which faces away from the end portion, and a holding leg connected to the ridge, the ridge having a first recess and the holding leg having a second recess, the holding leg including two side clips arranged in parallel with one another, a lower contact leg, and an upper transverse web, the upper transverse web separating the first recess in the ridge and the second recess in the holding leg from one another, wherein a first tab is formed on the upper transverse web and the clamping spring is configured to be mounted on the metal part such that the first tab engages in the opening in the spring receiving portion from the inner side and the end portion of the spring leg rests against the inner side of the contact portion and so as to exert a spring force on the inner side of the contact portion.

2. The electrical connection terminal according to claim 1, wherein the upper transverse web rests against the inner side of the spring receiving portion.

3. The electrical connection terminal according to claim 1, wherein a length of the first tab corresponds to a material thickness of the fastening leg.

4. The electrical connection terminal according to claim 1, wherein a region of the contact portion is angled downwards and the lower contact leg rests against the outer side of the angled contact portion.

5. The electrical connection terminal according to claim 1, wherein an. edge region of the contact portion has two indentations, in each of which a side clip engages.

6. The electrical connection terminal according to claim 1, wherein the ridge has two ribs which are arranged in parallel with one another and the spring receiving portion of the fastening leg has two indentations in an edge region of the fastening leg, and one rib engages in each indentation.

7. The electrical connection terminal according to claim 1, wherein the upper transverse web has a second tab facing an opposite direction to the first tab.

8. The electrical connection terminal according to claim 1, wherein the clamping spring and the metal part both include punched bent parts.

* * * * *